US007032390B2

(12) United States Patent
Brødreskift

(10) Patent No.: US 7,032,390 B2
(45) Date of Patent: Apr. 25, 2006

(54) METHOD FOR RECOVERY OF VOC GAS AND AN APPARATUS FOR RECOVERY OF VOC GAS

(75) Inventor: Knut Brødreskift, Tranby (NO)

(73) Assignee: Hamworthykse Gas Systems A.S., Asker (NO)

( * ) Notice: Subject to any disclaimer, the term of this patent is extended or adjusted under 35 U.S.C. 154(b) by 150 days.

(21) Appl. No.: 10/485,211

(22) PCT Filed: Jul. 29, 2002

(86) PCT No.: PCT/NO02/00272

§ 371 (c)(1),
(2), (4) Date: Jan. 29, 2004

(87) PCT Pub. No.: WO03/011420

PCT Pub. Date: Feb. 13, 2003

(65) Prior Publication Data

US 2004/0194474 A1 Oct. 7, 2004

(30) Foreign Application Priority Data

Jul. 31, 2001 (NO) ..... 20013747

(51) Int. Cl.
*F17C 3/10* (2006.01)
*F17C 13/08* (2006.01)

(52) U.S. Cl. ..... 62/48.2; 62/53.2

(58) Field of Classification Search ..... 62/48.2, 62/53.2

See application file for complete search history.

(56) References Cited

U.S. PATENT DOCUMENTS

| | | | | |
|---|---|---|---|---|
| 3,945,214 | A * | 3/1976 | Darredeau et al. | 62/48.2 |
| 4,875,436 | A * | 10/1989 | Smith et al. | 122/7 R |
| 5,050,603 | A * | 9/1991 | Stokes et al. | 123/523 |
| 5,176,002 | A * | 1/1993 | O'Brien et al. | 62/48.2 |
| 5,524,456 | A | 6/1996 | Stokes | |
| 5,678,423 | A | 10/1997 | Davies et al. | |
| 5,740,682 | A * | 4/1998 | Lavie | 62/617 |
| 5,860,294 | A * | 1/1999 | Brendeng | 62/619 |
| 6,901,762 | B1 * | 6/2005 | Irie et al. | 62/48.2 |
| 2001/0042377 | A1 * | 11/2001 | Pozivil | 62/48.3 |

FOREIGN PATENT DOCUMENTS

| | | |
|---|---|---|
| WO | 94/17325 | 8/1994 |
| WO | 97/40307 | 10/1997 |

* cited by examiner

*Primary Examiner*—William C. Doerrier
(74) *Attorney, Agent, or Firm*—Young & Thompson

(57) ABSTRACT

Recovered, compressed VOC gas is used as fuel for a steam system where the steam produced is used for the operation of one or more compressors (26,28,30) that are used for the compression of the VOC gas.

8 Claims, 3 Drawing Sheets

METHOD FOR RECOVERY OF VOC GAS AND AN APPARATUS FOR RECOVERY OF VOC GAS

BACKGROUND OF THE INVENTION

The invention relates to a process for the recovery of VOC gas.

The invention also relates to a plant for the recovery of VOC gas.

DESCRIPTION OF THE RELATED ART

The emission of VOCs (Volatile Organic Compound hydrocarbon gases) from tankers during loading is an environmental problem. To reduce or eliminate emissions, it is known to condense the VOC gas and store it.

The condensation process is energy-consuming, as compressors must be used to increase the pressure on the gas prior to condensation. Today electric motors are used to power the compressors. This is complex and expensive. The system also causes pollution because heavy oil is used as fuel for power generator units.

NO 176 454 discloses a plant for the production of combustion gas from the boil-off from liquefied gas and any gas produced on the evaporation of the liquefied gas. The plant employs a combined heat exchanger in which boil-off and liquefied gas are heated. A combined stream of superheated gas can be supplied to a compressor via a common mixing chamber in the combined heat exchanger.

SUMMARY OF THE INVENTION

The object of the present invention is to collect or recover VOC gas in an energy-efficient and environmentally friendly manner.

BRIEF DESCRIPTION OF THE DRAWINGS

The invention will now be described in more detail with reference to the drawings, wherein.

DESCRIPTION OF THE PREFERRED EMBODIMENTS

Figure 1:
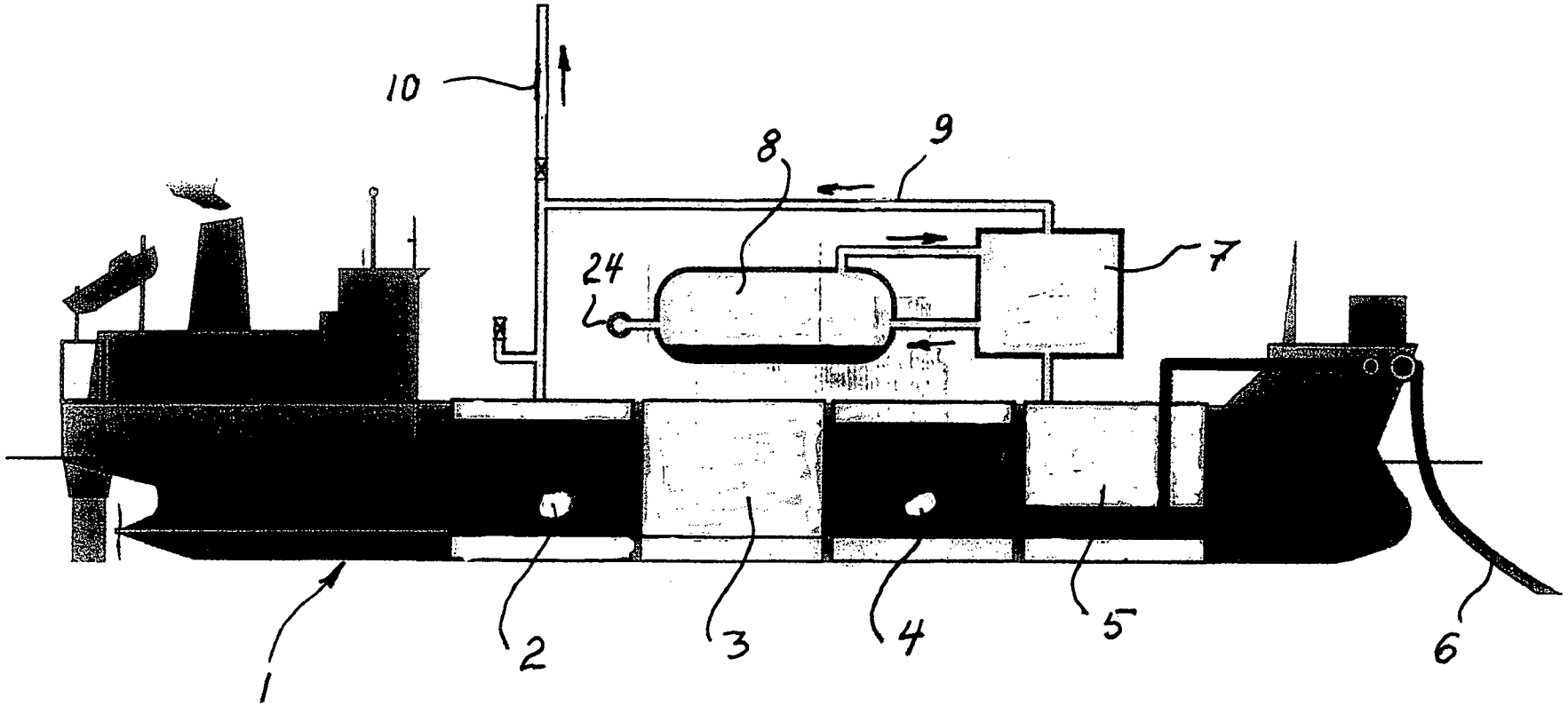
FIG. 1 shows a tanker during the loading of crude oil, fitted with a known recovery plant.

For a better understanding of the invention, an example of the prior art will first be discussed in more detail, with reference to FIGS. 1 and 2.

A tanker 1 has a plurality of tanks 2, 3, 4 and 5. The tank 5 is in the process of being loaded through the loading hose 6. The tanks 2 and 4 are fully loaded whilst the tank 3 is empty.

In FIG. 1, a plant on board the tanker 1 for the recovery VOC gas and inert gas is shown connected to the tank 5, which is in the process of being loaded. The recovery plant comprises a condensation plant 7 and a storage tank 8 for condensed, i.e., liquefied VOC. In the situation shown in FIG. 1, the condensation plant 7 is connected to the tank 5 which is in the process of being loaded. Inert gas and VOC then pass to the condensation plant 7. Condensed VOC gas is stored in storage tank 8. Inert gas passes through the pipe 9 to a ventilation riser 10.

Figure 2:
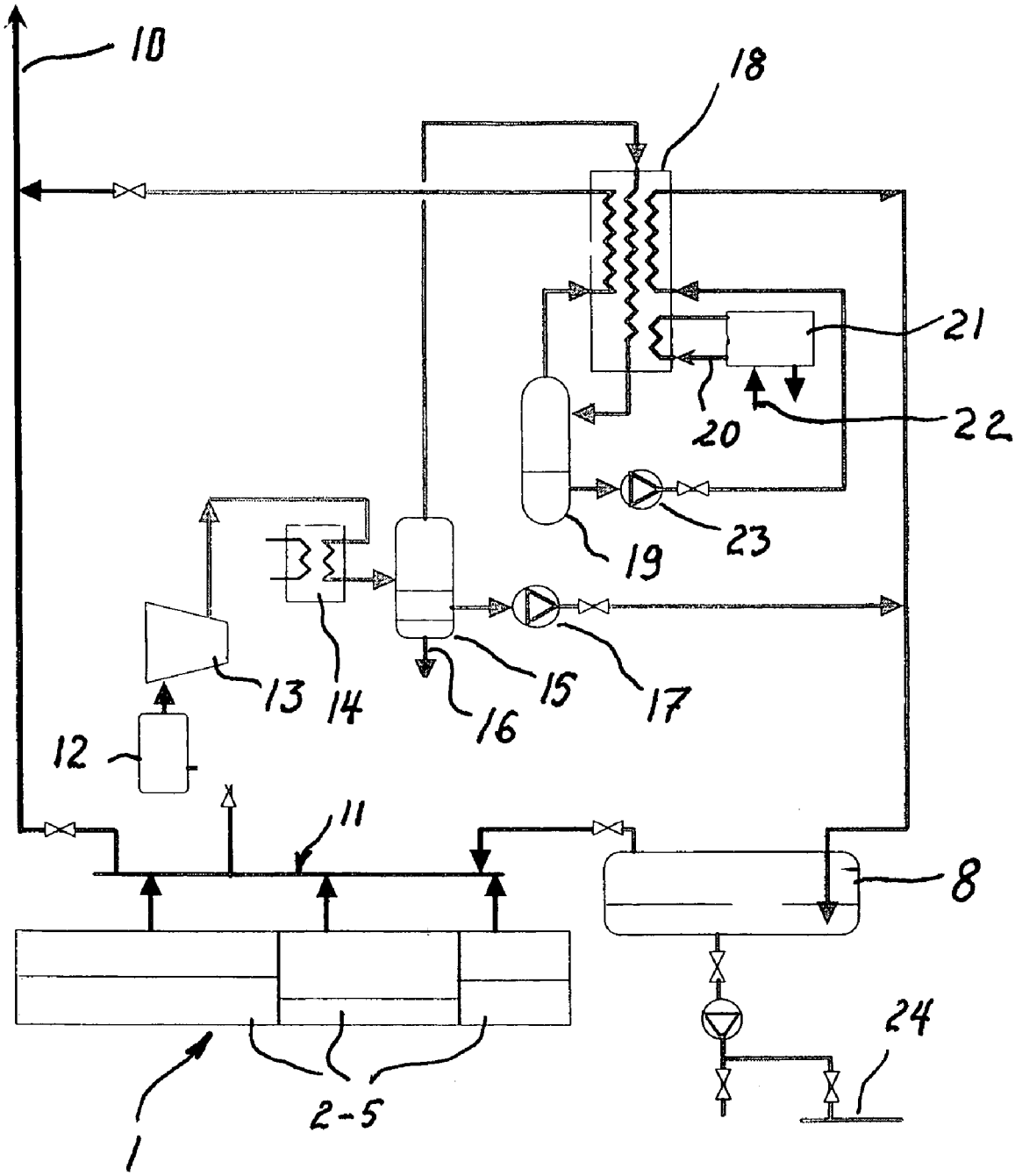
FIG. 2 shows a known process arrangement that is used on board the tanker in FIG. 1.

More details of the process plant are shown in FIG. 2, which shows the tanker 1 and the VOC condensate tank 8. The tanks on board the tanker 1 are connected via a pipe arrangement 11 to a demister 12 (mist collector), from where the VOC gas passes to a compressor 13. The compressor is powered in a known way by a non-illustrated electromotor. The compressed gas passes from the compressor 13 to a seawater-cooled condenser 14, and thence to a three-phase separator 15. In the separator water is drained through a pipe 16. The VOC is separated from the water and pumped 17 to the VOC tank 8.

Dry gas passes from the separator 15 to a two-stage heat exchanger (condenser) 18. In the first stage of the heat exchanger 18, surplus gas and cold VOC from the two-stage separator 19 are used as coolant. In the second stage of the heat exchanger 18, cold propylene 20 is used a coolant. Seawater 22 is used to cool the cooling system 21.

The gas/liquid mix passes to the separator where light hydrocarbons such as ethane, propane and butane fall out as liquid.

Liquefied VOC is pumped 23 via the heat exchanger 18 and is mixed with liquid from the separator 15 before entering the VOC storage tank 8, which is located on the tanker 1 deck. Pipes runs from the VOC tank 8 to a deck manifold 24.

Energy for the operation of the process arrangement shown and described above can be taken from the ship's own power plant if surplus energy is available. If not, a separate power unit installed on board the ship is used.

The recovered VOC can be fed back to the load (crude oil) or exported onshore for use there as a combustible, or for further treatment (refining).

According to the invention, the VOC gas produced during loading is used for the production of steam, which is used for the operation of steam turbines which in turn drive the gas compressors in the recovery plant. The VOC condensate and surplus gas are thus used as fuel in a steam system. Furthermore, the VOC condensate can also advantageously be used as "inert" oxygen-free blanket gas in the cargo tanks.

Figure 3:
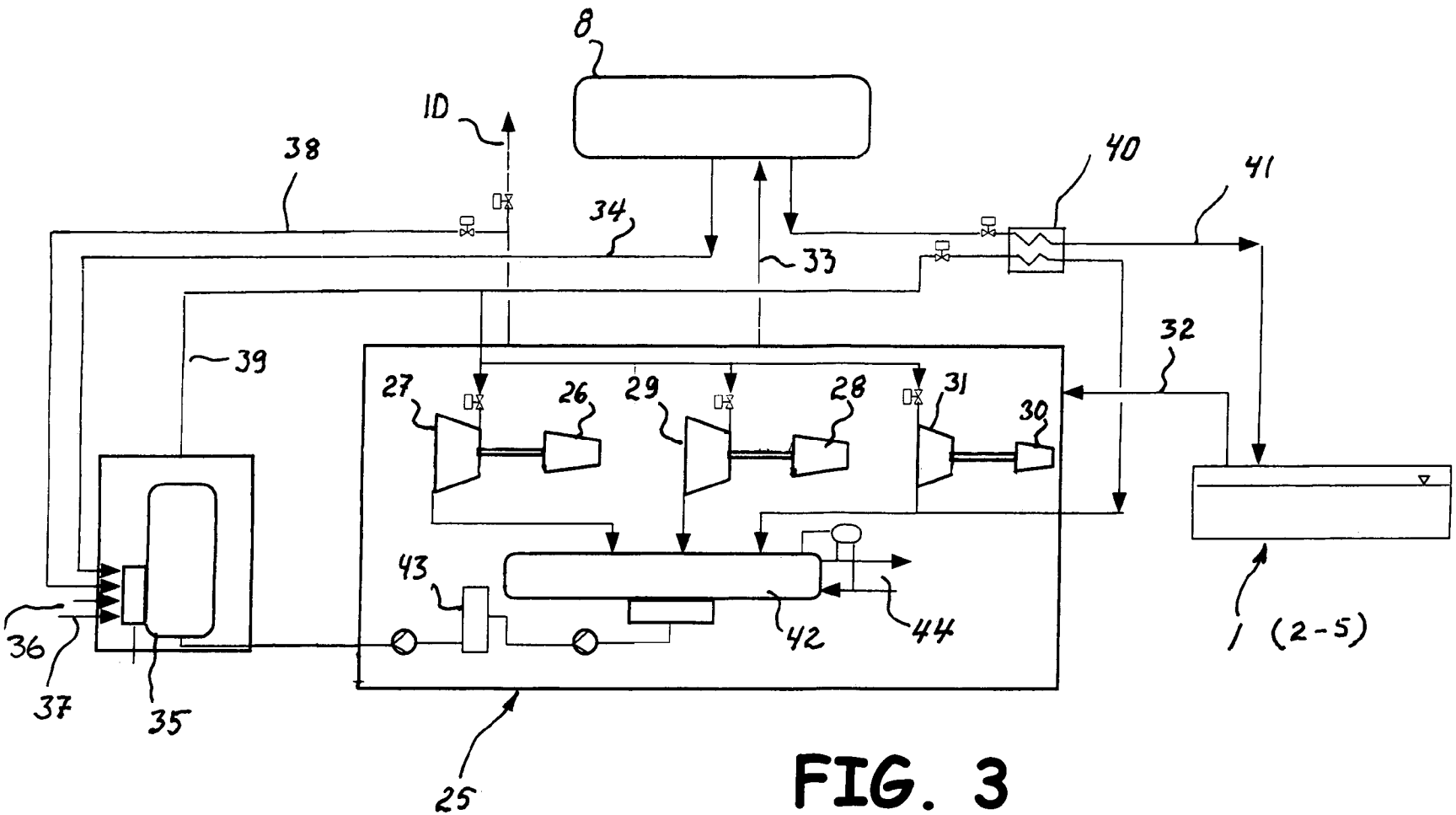
FIG. 3 shows a new process arrangement in which the invention is used.

The invention will now be described in more detail with reference to FIG. 3, which shows a process plant according to the invention.

A VOC recovery plant 25 is installed on the deck of the tanker 1. A VOC condensate tank 8 is also arranged on the tanker's 1 deck. A ventilation riser 10 runs from the VOC recovery plant 25, see also FIGS. 1 and 2.

The VOC recovery plant 25 comprises a first compressor 26 which is driven by a steam turbine 27, a second compressor 28 which is driven by a steam turbine 29, and a compressor 30 with associated steam turbine 31. The compressor 30 and the turbine 31 are integral parts of a cooling system (see FIG. 2).

VOC gas passes through a pipe 32 from the tanker 1 to the VOC recovery plant 25. The VOC condensate produced by means of the compressors 26, 28 and the cooling system 30, 31 passes through a pipe 33 to the VOC condensate tank 8.

A pipe 34 runs from the VOC condensate tank 8 to a boiler 35, where the VOC condensate from the tank 8 is used as fuel (combustible). Air and heavy oil are added when needed as indicated by the arrows 36 and 37.

Surplus gas exits through the ventilation riser 10 and can be supplied through the branched pipe 38 to the boiler 35 for combustion therein. The surplus gas passing through the pipe 38 will contain methane, ethane and N2.

Steam from the boiler 35 passes through the steam pipe 39 to the turbines 27, 29, 31 and also passes through a heat exchanger 40 where VOC condensate from the tank 8 is heated and can be supplied through the pipe 41 to the relevant cargo tank on board the tanker 1 as blanket gas.

The turbines 27, 29, 31 are connected to a condenser 42 from which condensate passes to a feed-water tank 43, and thence to the boiler 35. Seawater cooling is indicated by the arrows at 44.

In a practical embodiment, the VOC condensate tank 8 may have a volume of 450 $m^3$ and work under a pressure of 5–12 bar. The turbines 27, 29 can each supply 1400 kW, at 3600 revolutions per minute. The turbine 31 in the cooling system may, for example, supply 600 kW at 3600 revolutions per minute. The working pressure in the condenser may be 0.2 bar Abs. The boiler 35 can supply steam at 16 bar Abs and has a capacity of 38 tonnes per hour. An ordinary dual fuel burner can be used as burner in the boiler 5. Thus, the invention allows the condensate produced from degassing in the cargo tanks to be used as fuel for the boiler, which produces steam for the operation of the recovery plant. Surplus gas which is not normally recovered and which would otherwise enter the atmosphere is mixed with the air intake of the boiler 35 and is combusted there.

Because the VOC condensate is regenerated into inert gas, it will initially be possible to have a saturated gas atmosphere which reduces the degassing in the tanks. On the conventional use of inert gas ($N_2$+$CO_2$) in the tank atmosphere, hydrocarbons will easily be mixed and there will be an increase in the gas generation. This is particularly unfavourable at the start of loading, as there is a great deal of $N_2$ in the inert gas. At the same time there will be a large amount of gas to process, which requires more energy. This is avoided by means of the invention.

The invention claimed is:

1. A process for the recovery of VOC gas that is formed during the loading of hydrocarbons into a tank, which VOC gas is collected, compressed, cooled and fed to a VOC condensate tank, characterised in that the VOC condensate is used as fuel for a steam system, and that the steam produced in the steam system is used for the operation of compressors for said compression of the VOC gas, characterised in that surplus gas from the recovery is fed to the steam system as a supplement to said fuel.

2. A process according to claim 1, characterised in that the steam produced in the steam system is used for the operation of a cooling system for said cooling.

3. A process for the recovery of VOC gas that is formed during the loading of hydrocarbons into a tank, which VOC gas is collected, compressed, cooled and fed to a VOC condensate tank, characterised in that the VOC condensate is used as fuel for a steam system, and that the steam produced in the steam system is used for the operation of compressors for said compression of the VOC gas, characterised in that the VOC condensate is heat-exchanged with the steam and fed back into the tank as blanket gas.

4. A plant for the recovery of VOC gas that is formed during the loading of hydrocarbons into a tank, comprising one or more compressors (26, 28, 30) for the VOC gas, a cooling system (30, 31) for the compressed VOC gas and a VOC condensate tank (8), characterised in that said compressor or compressors (26, 28, 30) are connected to a respective steam turbine (27, 29, 31), and that the VOC condensate tank (8) is connected to a boiler (35) for the production of steam by whilst using the VOC condensate as fuel in the boiler (35), the boiler (35) being connected to said steam turbine or turbines (27, 29, 31) and characterised by a heat exchanger (40) for heat exchanging VOC condensate from the VOC condensate tank (8) with steam from the boiler (35), for the regeneration of the VOC condensate to a suitable blanket gas.

5. A plant according to claim 4, characterised in that the boiler (35) is connected to one (31) of the turbines for operation of a cooling compressor (30) for the VOC gas.

6. A process according to claim 3, characterised in that surplus gas from the recovery is fed to the steam system as a supplement to said fuel.

7. A process according to claim 1, characterised in that the VOC condensate is heat-exchanged with the steam and fed back into the tank as blanket gas.

8. A process according to claim 3, characterised in that the steam produced in the steam system is used for the operation of a cooling system for said cooling.

* * * * *